United States Patent [19]

Ibrahim

[11] 4,304,100

[45] Dec. 8, 1981

[54] ENERGY SAVING REFRIGERATION SYSTEM WITH MECHANICAL SUBCOOLING

[75] Inventor: Fayez F. Ibrahim, Niles, Mich.

[73] Assignee: Tyler Refrigeration Corporation, Niles, Mich.

[21] Appl. No.: 78,400

[22] Filed: Sep. 24, 1979

[51] Int. Cl.[3] ..... F25B 39/04

[52] U.S. Cl. ..... 62/183; 62/DIG. 17

[58] Field of Search ..... 62/DIG. 17, 181, 183, 62/184

[56] References Cited

U.S. PATENT DOCUMENTS 3,357,199 12/1967 Harnish ..... 62/183 X 4,136,528 1/1979 Vogel et al. ..... 62/DIG. 17

*Primary Examiner*—Lloyd L. King

*Attorney, Agent, or Firm*—LeBlanc, Nolan, Shur & Nies

[57] ABSTRACT

A refrigeration system employs mechanical subcooling to substantially increase the efficiency of operation and reduce power consumption. The refrigeration system includes a compressor for compressing a gaseous refrigerant, a condenser for condensing the gaseous refrigerant and subcooling the liquid refrigerant, a receiver for receiving the liquid and a plurality of display cases having evaporators for evaporating the liquid refrigerant.

A supplemental subcooling system, including a subcooling evaporator associated with the receiver discharge further subcools the condensed refrigerant before it is passed to the display case evaporators. The compressed gaseous refrigerant is first condensed at a condensing temperature of approximately 10° to 25° F. above a preselected cooling temperature. The condensed liquid is then mechanically subcooled if necessary to the preselected cooling temperature which should be preferably approximately 50° F.

13 Claims, 2 Drawing Figures

ENERGY SAVING REFRIGERATION SYSTEM WITH MECHANICAL SUBCOOLING

BACKGROUND OF THE INVENTION

The present invention relates to a closed cycle refrigeration system utilizing a remote condenser and constructed so as to improve the efficiency of operation of the system and reduce the power consumption.

This invention is related to the subject matter disclosed and claimed in U.S. Pat. application Ser. No. 57,350 filed July 13, 1979 by Fayez Abraham and Edward Bowman, and assigned to Tyler Refrigeration Corporation; the disclosure of said Ser. No. 57,350 is incorporated herein in its entirety by reference.

In the basic closed cycle refrigeration system, gaseous refrigerant is compressed to a high temperature. The high temperature compressed gas passes through a condenser where it gives up heat to the ambient and is condensed to a liquid. The pressure within the condenser is maintained at an appropriate level so that the gaseous refrigerant will be transformed into a liquid at a temperature level higher than the ambient air. The condensed liquid refrigerant is collected in a receiver and is conducted from a the receiver to an expansion valve, or other metering device, where it is expanded and passed through an evaporator within a display case. As the expanded liquid refrigerant flows through the evaporator, it extracts heat from the display case and is converted back to a gaseous state. This gaseous refrigerant is returned to the compressor and the cycle is continued.

Throughout the present description, references to "high side" are to the high pressure side of the system (upstream of the expansion valve or other metering device) or portion thereof. References to "low side" are to the low pressure side of the system (downstream of the metering device) or portion thereof. The liquid side of the system is generally considered to be between the outlet of the condenser and the metering device. The low pressure gas side or "suction side" lies between the metering device and the compressor. The metering device referred to herein is that device that controls the flow of liquid refrigerant to the evaporators.

In order to condense hot gaseous refrigerant, the condenser must be able to give up refrigerant heat to the ambient. Therefore, the condenser must operate at a higher temperature than the ambient. Traditionally, the condenser is operated at a preselected design temperature level, determined as a function of the highest ambient temperature during a normal period of the warmest season in a particular area. The condenser is then operated to condense the gaseous refrigerant at a temperature at least 10° F. above the design temperature. Thus if the design temperature is 90° F., then the condenser design temperature is normally set at 100°l F.

With the advent of the energy crises, and steadily rising utility costs, significant attention has been given to improving the energy efficiency of refrigeration systems. In large installations, such as supermarkets, there are typically large numbers of refrigerated display cases and hence, typically a plurality of compressor units are employed to satisfy the heavy refrigeration load required under certain conditions, such as during the warmer periods of the year. It is highly desirable to increase the operating efficiency of the refrigeration system and thereby reduce its operating cost. Such savings can be substantial for large installations.

Increased operating efficiency of the overall system can be achieved, at least in part, by improving the operating efficiency of the compressor unit (the compressor unit may comprise one or more individual compressors connected in tandem, i.e. parallel, or in series). One way to improve compressor unit efficiency is to increase the compressor capacity. By improving the capacities of the compressors of a tandem coupled compressor unit, there are times when less than all of the compressors need to be operated in order to run the refrigeration system. This results in a savings in the power consumption of the refrigeration system.

It has been recognized that the design temperature is only likely to occur a few days in a year, and then only during the day and not at night. In light of this, refrigeration systems have been modified so that the condenser operating temperature follows the ambient temperature while always remaining at least 10° F. above the ambient temperature.

By decreasing the condensing temperature 10° F., the compressor capacity will increase 6%. Consequently, if the condensing temperature is dropped from 100° F. to 75° F., for example, the compressor unit capacity will increase by approximately 15%; simultaneously, the compressor unit power consumption will be reduced. The effect of the increase in compressor unit capacity will result in an approximately 8% reduction in power consumption for every 10° F. drop in condensing temperature, assuming a constant refrigeration load. Consequently, the drop in the condensing temperature from 100° F. to 75° F. will reduce the power consumption of the refrigeration system by about 20%, assuming a constant refrigeration load.

The efficiency of the compressor unit also can be improved by subcooling the liquid refrigerant since the refrigerant will then extract 15% to 25% more heat per pound circulated. For every 10° F. subcooling of the liquid refrigerant, the compressor efficiency will increase by 5%. This improvement in the efficiency of the compressor also results in a reduction in the power consumption.

SUMMARY OF THE INVENTION

This invention provides controlled subcooling of condensed refrigerant on the high side of the refrigeration system. The refrigeration system described in copending related application Ser. No. 57,350 provides subcooling of the liquid refrigerant; however, in the system described in said copending related application, the amount of subcooling is depend a function of the ambient temperature. Preferably, for optimum efficiency, in terms of reduced operating costs without a consequent reduction in refrigeration capacity, the condensed liquid refrigerant temperature should remain relatively constant at all significant times, e.g., as long as the system is operating in it refrigeration mode.

In order to operate the refrigeration system at maximum efficiency, it is preferable and advantageous to maintain the temperature of the condensed liquid refrigerant at about 50° F. With the system described in the aforesaid copending related application Ser. No. 57,350, the liquid refrigerant temperature will be in this approximately 50° F. range only when the ambient temperature is 40° F. or less. If the ambient temperature arises above 40° F., the liquid refrigerant temperature will follow within about 10° F. above ambient.

The present invention provides a second stage of subcooling, whereby the temperature of the high side liquid refrigerant will be maintained at about 50° F. whenever the ambient is higher then 50° F. A mechanical subcooling system is provided which is energized only if the temperature of the liquid refrigerant rises to about 60° F. and is turned off when the liquid refrigerant temperature is reduced to about 50° F.

Although lower subcooling temperatures can be achieved, systems using such lower subcooling temperatures would be uneconomical due to added cost of additional insulation that would be required around the liquid lines and receiver.

The mechanical subcooling system is employed with a refrigeration system having a main refrigeration circuit which comprises a main compressor unit, a remote condenser coupled to the compressor unit through a compressor discharge conduit for condensing the gaseous refrigerant to a liquid, and subcooling the liquid refrigerant naturally, a receiver coupled to the condenser, evaporators coupled in parallel to each other and to the receiver through a liquid line conduit for evaporating the liquid refrigerant at a relatively low pressure; and a suction return coupling the evaporators to the compressor for returning evaporated refrigerant from the evaporator to the compressor. An auxiliary subcooling system is interposed in the main refrigerant flow path between the condenser and evaporators for monitoring the temperature of the refrigerant in the main flow path and for maintaining the temperature of that refrigerant within a preset temperature range.

In one embodiment, the auxiliary subcooling system comprises an auxiliary compressor unit, an auxiliary condenser coupled to the auxiliary compressor, and a heat exchanger coupled to the auxiliary condenser and auxiliary compressor to form an auxiliary refrigeration circuit separate from the main refrigeration circuit. The heat exchanger is coupled to the main refrigerant flow path between the receiver and the evaporators for extracting heat from the refrigerant flowing between the receiver and evaporators when the auxiliary subcooling system is energized. Temperature sensing means are located upstream of the heat exchanger for measuring the refrigerant temperature in the main refrigerant flow path upstream of the heat exchange means; control means are coupled to the temperature sensing means and the auxiliary compressor for energizing the auxiliary compressor to cause refrigerant to flow through the auxiliary refrigeration circuit when the refrigeration temperature measured by the temperature sensing means exceeds a first preset upper limit and for terminating the flow of refrigerant through the auxiliary refrigeration flow path when the refrigerant temperature measured by the temperature means drops below a second lower limit equal to or less then the first preset upper limit. When the auxiliary refrigeration circuit is energized, the heat exchanger extracts heat from the refrigerant flowing through the main refrigerant flow path between the receiver and evaporators.

In a second embodiment, the auxiliary subcooling means comprises an auxiliary compressor having its discharge coupled to the main condensor system, a heat exchanger coupled to the main refrigerant flow path between the receiver and evaporators, a refrigerant flow line coupled between the receiver outlet and the heat exchange inlet for supplying refrigerant to the heat exchanger from the main refrigeration circuit, and a return conduit coupling the heat exchanger to the input of the auxiliary compressor for completing an auxiliary refrigeration flow path through the heat exchanger and auxiliary compressor; the heat exchanger extracts heat from refrigerant flowing in the main refrigerant flow path between the receiver and evaporators when the auxiliary subcooling means is energized.

DESCRIPTION OF PREFERRED EMBODIMENT(S)

The present invention is described in connection with a commercial refrigeration system manufactured by Tyler Refrigeration Corporation, under the trade name "SCOTCH TWOSOME" and described in detail in Tyler Installation and Service Manual for Scotch Twosome Condensing Unit Assemblies, Rev. 5/78. It should be understood, however, that the invention is not limited to the Scotch Twosome assembly; the various embodiments of the present invention may be incorporated in and are applicable to any closed cycle refrigeration system.

Figure 1:
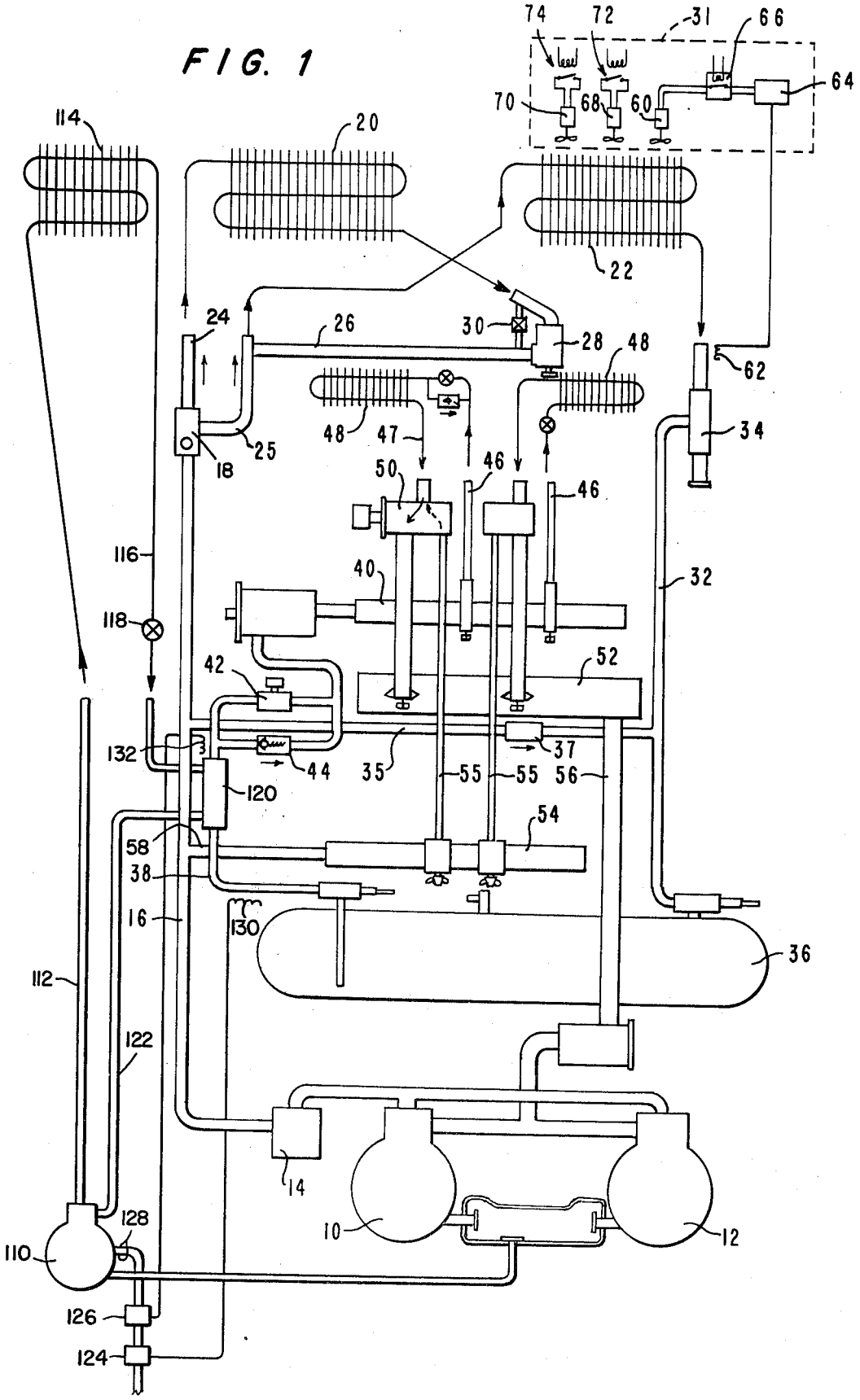
FIG. 1 is a schematic illustration of a first embodiment of a refrigeration system in accordance with the present invention.

As illustrated in FIG. 1, the refrigeration system includes two compressors 10 and 12 which form a Scotch Twosome unit. Compressors 10 and 12 are connected in tandem, i.e. in parallel. The compressor discharge is connected through an oil separator 14 to a main compressor discharge gas conduit 16. A solenoil operated heat recovery valve 18 may advantageously be interposed in conduit 16 so as to selectively connect the heat recovery coil 20 in series flow relationship with a remote condenser 22. Valve 18 connects conduit 16 to the upstream side of coil 20 through a heat recovery branch conduit 24. Valve 18 also connects conduit 16 to the upstream side of remote condenser 22 through a remote condenser conduit 25. The downstream side of heat recovery coil 20 is connected to conduit 25 and hence remote condenser 22 by a conduit 26 that contains a pressure regulator 28. A bypass solenoid 30 may be provided for enabling refrigerant to circumvent regulator 28. When solenoid 30 is open, a portion, for example one-third, of the heat of rejection will be recovered to the store. This effectively causes a drop in the pressure and hence temperature of the gaseous refrigerant in heat recovery coil 20.

The downstream side of remote condenser 22 is connected through a conduit 32 and pressure regulator 34 to a receiver tank 36. A pressure regulating bypass line 35 connects compressor output conduit 16 with the receiver 36 through a check valve 37. A liquid line 38 connects the liquid phase of receiver 36 with a liquid manifold 40 through a main liquid solenoid valve 42 and parallel connected check valve 44. One or more liquid lines 46 connect the liquid manifold 40 to the remotely located evaporators 48 associated, for example, with respective refrigerated display cases or cold rooms, generally in a store such as a supermarket. The downstream side of each evaporator is connected through a corresponding evaporator return line 47 to a suction manifold 52. Suction manifold 52 is connected through a suction conduit 56 to the intake of compressors 10 and 12.

During the normal refrigeration operation, liquid refrigerant flows through liquid manifold 40 into evaporator 48. The evaporated refrigerant flows through a three-way valve 50 into suction manifold 52 and from there is returned to the compressors through suction conduit 56. If the refrigeration system incorporates gas defrost, during the defrost cycle the flow of liquid refrigerant is terminated temporarily and gaseous refrigerant is supplied to evaporator coil 48 from a compressor discharge branch conduit 58 and a gas defrost manifold 54. The gaseous refrigerant gives up heat to the evaporator coil and the condensed refrigerant is returned to the liquid manifold through 3-way valve 50 and defrost gas return conduit 55. Details of one such gas defrost system are described in co-pending application Ser. No. 952,612, filed Oct. 18, 1978 by Arthur Perez and Fayez Abraham, and assigned to Tyler Refrigeration Corporation. The disclosure of Ser. No. 952,612 is incorporated herein by reference.

Except for the heat recovery coil 20, remote condenser 22, evaporators 48 and their associated connected conduits 46 and 47, all of the above described components may advantageously form part of a unitary package mounted to a main frame or rack located in the compressor room of a store. The respective display cases containing evaporators 48 are located at convenient places throughout the public area of the store or within certain select storage locations within the store. Connecting conduits 46 and 47, therefore, may be between about 50 and 300 feet in length. Remote condenser 22 is usually located on the roof of the store, at a distance of typically between 40 and 100 feet from the compressor room. The heat recovery coil is normally located in the store air handling system where it can give out heat to the store air circulation system when desired.

A cooling unit 31 is provided to subcool the refrigerant flowing through the remote condenser during the refrigeration mode. Cooling unit 31 includes three fans (or sets of fans) 60,68 and 70. The operation of fan 60 is controlled by a thermostat 64 connected to a temperature sensor 62. Sensor 62 senses the temperature of the liquid downstream of the remote condenser and controls the thermostat 64 to turn on fan 60 when the liquid refrigerant temperature rises above a predetermined set point. A switch 66 disconnects fan 60 whenever the system is switched into a defrost cycle of operation.

In order to achieve the maximum benefit of subcooling and maximum cost justified operating efficiency, the liquid refrigerant should be subcooled to a temperature of at least about 10° to 25° F. below the condensing temperature, and preferably to about 50° F. If the pressure within remote condenser 22 is appropriately regulated so that the gaseous refrigerant is condensed at a temperature of 60° F., fan 60 can be operated for cooling the liquid to a temperature of 50° F. While a lower subcooling temperature is possible, due to the cost of extra insulation that would be needed along all of the liquid lines, subcooling to such a low level is generally economically impractical.

In a preferred mode of operation, thermostat 64 turns on fan 60 whenever the temperature of the liquid refrigerant as measured by sensor 62 rises above 55° F. and turns off fan 60 whenever the refrigerant temperature falls to 45° F. If a subcooling temperature higher than 50° F. is required, due, for example, to higher average ambient temperatures, then the operating range of thermostat 64 is similarly shifted.

Fans 68 and 70 of cooling unit 31 are responsive to other temperature determinations. Fan 68 is switched into operation by a relay switch 72 in dependence upon the pressure within the remote condenser. Since, pressure is directly proportional to temperature, relay 72 may be controlled by a sensor for measuring the temperature of the refrigerant in the condenser. Thus, if the liquid is being subcooled to 50° F., fan 68 is activated if the condenser pressure rises to a level where the temperature of the gaseous refrigerant becomes greater than 60° F. Fan 70 operates in response to the temperature of the ambient atmosphere rising above a certain preselected level. Thus, if the ambient temperature should, for example, rise above 70° F., then relay switch 74 activates fan 70.

A pressure regulator 34 is provided to control the pressure within remote condenser 22 so as to ensure proper condensing of the gaseous refrigerant. Pressure regulator 34 is located between remote condenser 22 and liquid conduit 32. Condensed refrigerant flows through the regulator 34, conduit 32 and into receiver 36.

The foregoing features of the refrigeration system of this invention are also disclosed in the aforementioned related application Ser. No. 57,350.

A primary limitation upon natural, or condenser, subcooling is the temperature of the ambient atmosphere surrounding the remote condenser. The liquid passing through the condenser cannot be subcooled to a level below the temperature of the ambient air since at that level all heat exchange ceases. The mechanical auxiliary subcooling system of this invention is provided to substantially reduce or eliminate such dependence of the refrigeration system on the ambient atmosphere and to therefore allow for a more controlled operation of the system.

In the embodiment shown in FIG. 1, an auxiliary compressor 110 is connected through a discharge conduit 112 to an auxiliary condenser 114. Condenser 114 may be located remote from the compressor 110 in the same manner as condensers 20 and 22; alternatively, condenser 114 may be sufficiently small so that it can be placed relatively close to the compresser 110 or even combined as a single compressor/condenser operating unit. Condenser 114 is connected through a conduit 116 and interposed metering device 118, such as a well known expansion valve, to an evaporator 120. Evaporator 120 is connected through a suction line 122 to the input or suction side of compressor 110. Evaporator 120 may comprise a heat exchanger of a type described, for example, in aforemention co-pending application Ser. No. 952,612.

A pair of relays or other power control devices 124, 126 are connected in series in power supply line 128 to compressor 110. Relay 124 is controlled by a thermostat 130 which measures the temperature of refrigerant following through conduit 38 from the discharge of receiver 36 to the liquid manifold 40 and evaporator 48; thermostat 130 is located upstream (in the direction of refrigerant flow) of the evaporator 120. Relay 126 is controlled by a thermostat 132 located downstream of evaporator 120 for measuring the temperature of refrigerant in conduit 38 downstream of evaporator 120.

In this embodiment, and in that of FIG. 2 described below, certain well-known elements, such as oil separators, pressure regulators, etc., which may be used in an actual refrigeration system in accordance with operating practices well-established in the refrigeration art are omitted here for the sake of clarity and conciseness.

Normally, liquid refrigerant flowing out of the receiver 36 in the main refrigerant circuit or flow path will be at a temperature determined by the natural subcooling effected by condenser 22 and cooling unit 31. If this temperature of liquid refrigerant in conduit 38 at the output of receiver 36 exceeds a predetermined maximum subcooling temperature, thermostat 130 energizes relay 124 to turn on compressor 110. This starts refrigerant flowing through an auxiliary closed cycle loop comprising discharge conduit 112, condenser 114, metering device 118, evaporator 120 and return conduit 122. Evaporator or heat exchanger 120 extracts heat from the liquid refrigerant in conduit 38 to further subcool the liquid refrigerant. Subcooling continues to take place until thermostat 132 senses a refrigerant temperature at the outlet side of evaporator 120 which is at or below a predetermined minimum subcooling temperature; thermostat 132 thereupon energizes relay 126 to cut off power to compressor 110 to thereby discontinue operation of the auxiliary refrigeration system. For the purposes described herein, control device 124 may comprise a normally open relay (i.e. switch contacts being normally open and closed to complete a circuit upon being energized) and control device 126 may comprise a normally closed relay (i.e. switch contacts being normally closed and opened to interrupt a circuit when the relay is energized).

Figure 2:
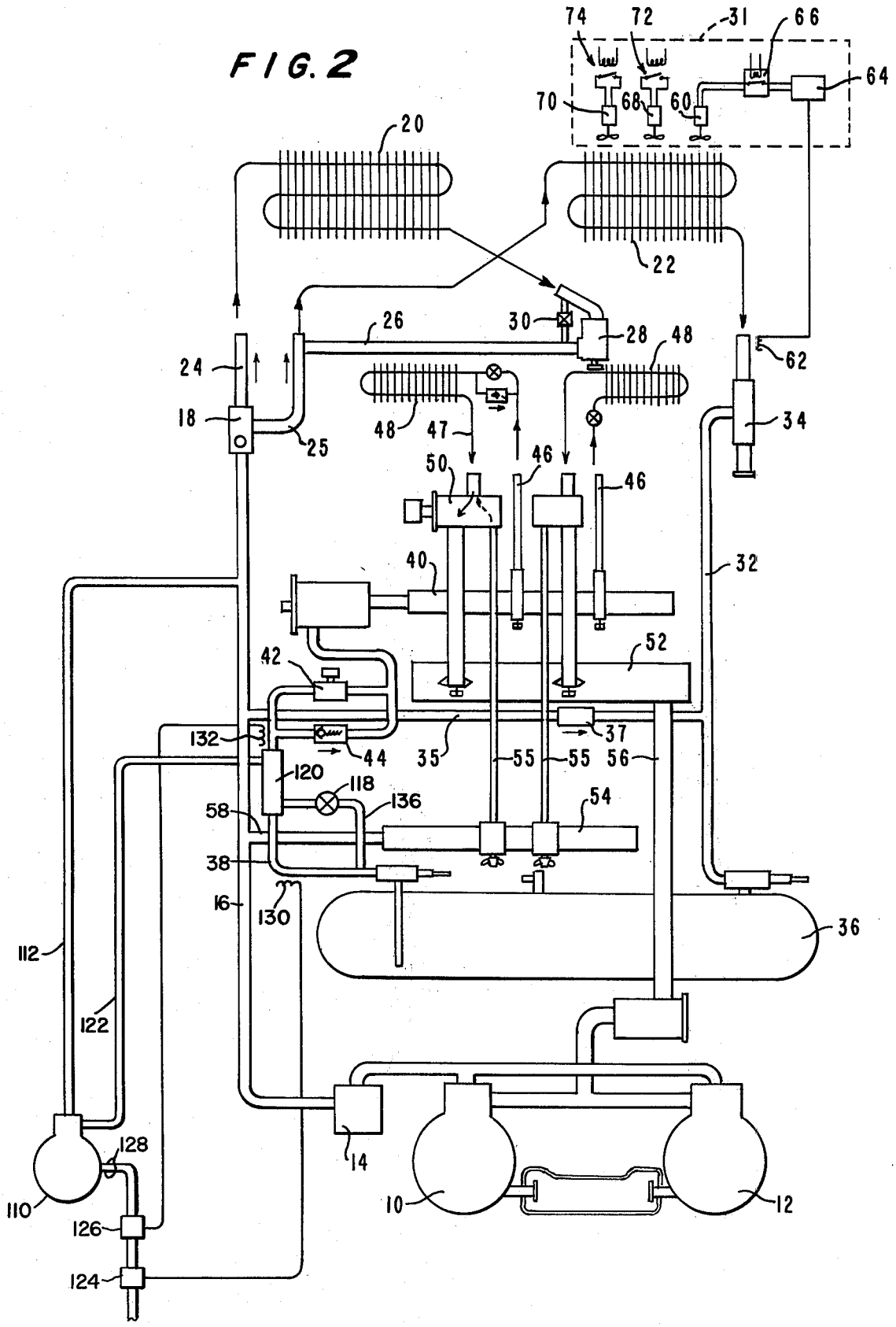
FIG. 2 is a schematic illustration of a second embodiment of a refrigeration system in accordance with the present invention.

FIG. 2 shows an alternate embodiment which eliminates the auxiliary condenser 114 and utilizes a portion of the main closed cycle refrigerant supply. In FIGS. 1 and 2, like elements are designated by the same reference numerals.

In this second embodiment, compressor discharge conduit 112 discharges directly into main compressor discharge conduit 16. Refrigerant for the evaporator 120 is drawn through a conduit 136 and metering device 118. Conduit 136 is connected to the outlet of receiver 36, for example, coming off liquid line 38 upstream of evaporator 120. The embodiment of FIG. 2 operates in the same manner as the above described embodiment of FIG. 1.

In the preferred mode of operation, to obtain maximum economic benefit from this auxiliary mechanical subcooling system, thermostat 130 is set to trigger at a nominal 55° F.; thermostat 132 is set to trigger at a nominal 45° F. Normally the measuring devices used have a 5 degree differential from nominal. Thus, thermostat 130 will trigger on at 60° F. and trigger off at 50° F.; thermostat 132 will trigger on at 50° F. and trigger off at 40° F.

It will be seen therefore that the auxiliary mechanical subcooling system of this invention only operates intermittently to maintain the temperature of the liquid refrigerant at a desired subcooled temperature. Further, the system will only operate long enough to bring the temperature of the liquid refrigerant down to the desired level; once the desired minimum subcooling temperature has been acheived, the system will shut itself off.

A principal advantage of this system is that it can reduce energy requirements for supermarket refrigeration systems since the auxiliary mechanical system can work with an efficiency in the range of 10 to 12 BTUs/Watt. This is in contrast to the ice cream system which works at an average efficiency of 4.3 BTUs/Watt; a meat system, at 6.8 BTUs/Watt; and a dairy system, at 7.8 BTUs/Watt.

It will therefore be seen that the auxiliary mechanical subcooling system of this invention operates at about twice the efficiency of low temperature (e.g. ice cream and/or frozen food) systems. The use of this auxiliary subcooling system allows for a reduction in total system horsepower by up to about 20%. It is feasible when using the system of this invention for low temperature installations to eliminate one pump, e.g. from four 10 horsepower compressors to three main compressors and an auxiliary compressor of substantially smaller horsepower rating and thus lower power requirements. Further, as noted above, the auxiliary compressor only operates intermittently whereas the main compressors operates substantially continuously.

The present invention may be embodied in other specific forms without departing from the spirit or essential characteristics thereof. The present embodiments are presented merely as illustrative and not restrictive, with the scope of the invention being indicated by the claims rather than the foregoing description. All changes which come within the meaning and range of equivalency of the claims are therefore intended to be embraced therein.

What is claimed is:

1. A refrigeration system comprising:

compressor means including at least one compressor unit, said compressor means compressing gaseous refrigerant having a relatively high temperature to a relatively high pressure;

condenser means coupled to said compressor means for condensing compressed gaseous refrigerant to a liquid state, said condenser means including means for cooling the condensed refrigerant ideally to a preselected liquid temperature level so that the liquid leaving said condenser means is subcooled, and temperature sensing means for sensing the temperature of the liquid leaving said condenser means and controlling the operation of said cooling means as a function of the temperature of the liquid refrigerant;

a receiver coupled to said condenser means for receiving the liquid refrigerant leaving said condenser means and temporarily storing such liquid;

evaporator means coupled to said receiver for receiving liquid refrigerant from said receiver and for evaporating the liquid refrigerant at a relatively low pressure when said evaporator means is in the refrigeration mode of operation; and auxiliary subcooling means interposed in the main liquid refrigerant flow path between said condenser means and evaporator means for monitoring the temperature of the liquid refrigerant and for maintaining the liquid refrigerant temperature within a preset temperature range.

2. A refrigeration system having a main refrigeration circuit comprising:

compressor means for compressing gaseous refrigerant having a relatively high temperature to a relatively high pressure;

condenser means coupled to said compressor means through compressor discharge conduit means for condensing the gaseous refrigerant to a liquid, said condenser means including means for subcooling the liquid refrigerant;

receiver means coupled to said condenser means for receiving the liquid leaving said condenser means and temporarily storing such liquid;

a plurality of evaporator means coupled in parallel to each other and to said receiver means through liquid line conduit means for receiving liquid refrigerant from said receiver means and evaporating the liquid refrigerant at a relatively low pressure; and suction means coupling said evaporator means to said compressor means for returning evaporated refrigerant from said evaporator means to said compressor means; said refrigeration system further comprising:

auxiliary subcooling means interposed in the main refrigerant flow path between said condenser and evaporator means for monitoring the temperature of the refrigerant in the main flow path and for maintaining the temperature of that refrigerant within a preset temperature range.

3. A refrigeration system comprising: compressor means including at least one compressor unit, said compressor means compressing gaseous refrigerant having a relatively high temperature to a relatively high pressure; condensor means coupled to said compressor means for condensing compressed gaseous refrigerant to a liquid state, said condenser means including means for cooling the condensed refrigerant ideally to a preselected liquid temperature level so that the liquid leaving said condenser means is subcooled, and temperature sensing means for sensing the temperature of the liquid leaving said condenser means and controlling the operation of said cooling means as a function of the temperature of the liquid refrigerant; a receiver coupled to said condenser means for receiving the liquid refrigerant leaving said condenser means and temporarily storing such liquid; evaporator means coupled to said receiver for receiving liquid refrigerant from said receiver and for evaporating the liquid refrigerant at a relatively low pressure when said evaporator means is in the refrigeration mode of operation; and auxiliary subcooling means interposed in the main liquid refrigerant flow path between said condenser means and evaporator means for monitoring the temperature of the liquid refrigerant and for maintaining the liquid refrigerant temperature within a preset temperature range, including heat exchange means interposed in the main liquid refrigerant flow path between the condenser means and evaporator means, temperature sensing means located upstream of said heat exchange means for measuring the refrigerant temperature upstream of the heat exchange means, and means coupled with and operated by said temperature sensing means for completing an auxiliary refrigerant flow path through the heat exchange means when the measured liquid refrigerant temperature exceeds a first preset upper limit and for terminating the auxiliary flow path through the heat exchange means when the measured refrigerant temperature drops below a second preset lower limit, equal to or less than said first preset upper limit.

4. A refrigeration system having a main refrigeration circuit comprising: compressor means for compressing gaseous refrigerant having a relatively high temperature to a relatively high pressure; condenser means coupled to said compressor means through compressor discharge conduit means for condensing the gaseous refrigerant to a liquid, said condenser means including means for subcooling the liquid refrigerant; receiver means coupled to said condenser means for receiving the liquid leaving said condenser means and temporarily storing such liquid; a plurality of evaporator means coupled in parallel to each other and to said receiver means through liquid line conduit means for receiving liquid refrigerant from said receiver means and evaporating the liquid refrigerant at a relatively low pressure; suction means coupling said evaporator means to said compressor means for returning evaporated refrigerant from said evaporator means to said compressor means; and auxiliary subcooling means interposed in the main refrigerant flow path and for maintaining the temperature of that refrigerant within a preset temperature range, including heat exchange means interposed in the main liquid refrigerant flow path between the condenser means and evaporator means, temperature sensing means located upstream of said heat exchange means for measuring the refrigerant temperature upstream of the heat exchange means, and means coupled with and operated by said temperature sensing means for completing an auxiliary refrigerant flow path through the heat exchange means when the measured liquid refrigerant temperature exceeds a first preset upper limit and for terminating the auxiliary flow path through the heat exchange means when the measured refrigerant temperature drops below a second preset lower limit, equal to or less than said first preset upper limit.

5. A refrigeration system according to claim 3 or 4, wherein:

said heat exchange means is coupled in said main liquid refrigerant flow path between said receiver and said evaporator means;

said temperature sensing means comprises a first sensor for measuring refrigerant temperature in the main refrigerant flow path between said receiver and said heat exchange means and a second sensor for measuring refrigerant temperature in the main refrigerant flow path downstream of the heat exchange means; and said means for completing and terminating said auxiliary refrigerant flow path includes auxiliary compressor means coupled with said heat exchange means to form an auxiliary refrigeration circuit, and control means coupled with said first sensor for energizing said auxiliary compressor means when the refrigerant temperature measured by said first sensor exceeds said preset upper limit and coupled with said second sensor for shutting off said auxiliary compressor means when the refrigerant temperature measured by the second sensor decreases below said preset lower limit.

6. A refrigeration system comprising: compressor means including at least one compressor unit, said compressor means compressing gaseous refrigerant having a relatively high temperature to a relatively high pressure; condensor means coupled to said compressor means for condensing compressed gaseous refrigerant to a liquid state, said condenser means including means for cooling the condensed refrigerant ideally to a preselected liquid temperature level so that the liquid leaving said condenser means is subcooled, and temperature sensing means for sensing the temperature of the liquid leaving said condenser means and controlling the operation of said cooling means as a function of the temperature of the liquid refrigerant; a receiver coupled to said condenser means for receiving the liquid refrigerant leaving said condenser means and temporarily storing such liquid; evaporator means coupled to said receiver for receiving liquid refrigerant from said receiver and for evaporating the liquid refrigerant at a relatively low pressure when said evaporator means is in the refrigeration mode of operation; and auxiliary subcooling means interposed in the main liquid refrigerant flow path between said condenser means and evaporator means for monitoring the temperature of the liquid refrigerant and for maintaining the liquid refrigerant temperature within a preset temperature range, including auxiliary compressor means, auxiliary condenser means coupled to said auxiliary compressor means and heat exchange means coupled to said auxiliary condenser means and auxiliary compressor means to form an auxiliary refrigeration circuit separate from the main refrigeration circuit, said heat exchange means being coupled to said main refrigerant flow path between said receiver and said evaporator means for extracting heat from the refrigerant flowing between said receiver and evaporator means when said auxiliary subcooling means is energized.

7. A refrigeration system having a main refrigeration circuit comprising: compressor means for compressing gaseous refrigerant having a relatively high temperature to a relatively high pressure; condenser means coupled to said compressor means through compressor discharge conduit means for condensing the gaseous refrigerant to a liquid, said condenser means including means for subcooling the liquid refrigerant; receiver means coupled to said condenser means for receiving the liquid leaving said condenser means and temporarily storing such liquid; a plurality of evaporator means coupled in parallel to each other and to said receiver means through liquid line conduit means for receiving liquid refrigerant from said receiver means and evaporating the liquid refrigerant at a relatively low pressure; suction means coupling said evaporator means to said compressor means for returning evaporated refrigerant from said evaporator means to said compressor means; and auxiliary subcooling means interposed in the main refrigerant flow path between said condenser and evaporator means for monitoring the temperature of the refrigerant in the main flow and for maintaining the temperature of that refrigerant within a preset temperature range, including auxiliary compressor means, auxiliary condenser means coupled to said auxiliary compressor means and heat exchange means coupled to said auxiliary condenser means and auxiliary compressor means to form an auxiliary refrigeration circuit seperate from the main refrigeration circuit, said heat exchange means being coupled to said main refrigerant flow path between said receiver and said evaporator means for extracting heat from the refrigerant flowing between said receiver and evaporator means when said auxiliary subcooling means is energized.

8. A refrigeration system according to claim 6 or 7, wherein said auxiliary subcooling means further includes temperature sensing means located upstream of said heat exchange means for measuring the refrigerant temperature in the main refrigerant flow path upstream of the heat exhange means, and means coupled to said temperature sensing means and said auxiliary compressor means for energizing said auxiliary compressor means to cause refrigerant to flow through said auxiliary refrigeration circuit when the refrigeration temperature measured by said temperature sensing means exceeds a first preset upper limit and for terminating the flow of refrigerant through said auxiliary refrigeration flow path when the refrigerant temperature measured by said temperature means drops below a second lower limit equal to or less then said first preset upper limit, whereby when said auxiliary refrigeration circuit is energized, said heat exchange means extracts heat from the refrigerant flowing through the main refrigerant flow path between said receiver and said evaporator means.

9. A refrigeration system according to claim 8, wherein said temperature sensing means comprises a first sensor for measuring refrigerant temperature in the main refrigeration flow path between said receiver and said heat exchange means and a second sensor for measuring refrigerant temperature in the main refrigerant flow path downstream of the heat exchange means, and control means coupled with said first sensor for energizing said auxiliary compressor means when the refrigerant temperature measured by said first sensor exceeds said preset upper limit, said control means being coupled with said second sensor for shutting off said auxiliary compressor means when the refrigerant temperature measured by the second sensor decreases below said preset lower limit.

10.A refrigeration system comprising: compressor means including at least one compressor unit, said compressor means compressing gaseous refrigerant having a relatively high temperature to a relatively high pressure; condenser means coupled to said compressor means for condensing compressed gaseous refrigerant to a liquid state, said condenser means including means for cooling the condensed refrigerant ideally to a preselected liquid temperature level so that the liquid leaving said condenser means is subcooled, and temperature sensing means for sensing the temperature of the liquid leaving said condenser and controlling the operation of said cooling means as a function of the temperature of the liquid refrigerant; a receiver coupled to said condenser means for receiving the liquid refrigerant leaving said condenser means and temporarily storing such liquid; evaporator means coupled to said receiver for receiving liquid refrigerant from said receiver and for evaporating the liquid refrigerant at a relatively low pressure when said evaporator means is in the refrigeration mode of operation; and auxiliary subcooling means interposed in the main liquid refrigerant flow path between said condenser means and evaporator means for monitoring the temperature of the liquid refrigerant and for maintaining the liquid refrigerant temperature within a preset temperature range, including auxiliary compressor means having its discharge coupled to said condensor means, heat exchange means coupled to said main refrigerant flow path between said receiver and said evaporator means, refrigerant flow line means coupled between the receiver outlet and the heat exchange inlet for supplying refrigerant to said heat exchange means from the main refrigeration circuit, and return conduit means coupling said heat exchange means to the input of said auxiliary compressor means for completing an auxiliary refrigeration flow path through said heat exchange means and auxiliary compressor means, wherein said heat exchange means extracts heat from refrigerant flowing in said main refrigerant flow path between said receiver and evaporator means when said auxiliary subcooling means is energized.

11. a refrigeration system having a main refrigeration circuit comprising: compressor means for compressing gaseous refrigerant having a relatively high temperature to a relatively high pressure; condenser means coupled to said compressor means through compressor discharge conduit means for condensing the gaseous refrigerant to a liquid, said condenser means including means for subcooling the liquid refrigerant; receiver means coupled to said condenser means for receiving the liquid leaving said condenser means and temporarily storing such liquid; a plurality of evaporator means coupled in parallel to each other and to said receiver means through liquid line conduit means for receiving liquid refrigerant from said receiver means and evaporating the liquid refrigerant at a relatively low pressure; suction means coupling said evaporator means to said compressor means for returning evaporated refrigerant from said evaporator means to said compressor means; and auxiliary subcooling means interposed in the main refrigerant flow path between said condenser and evaporator means for monitoring the temperature of the refrigerant in the main flow path and for maintaining the temperature of the refrigerant within a preset temperature range, including auxiliary compressor means having its discharge coupled to said condenser means, heat exchange means coupled to said main refrigerant flow path between said receiver and said evaporator means, refrigerant flow line means coupled between the receiver outlet and the heat exchange inlet for supplying refrigerant to said heat exchange means for the main refrigeration circuit, and return conduit means coupling said heat exchange means to the input of said auxiliary compressor means for completing an auxiliary refrigeration flow path through said heat exchange means and auxiliary compressor means, wherein said heat exchange means extracts heat from refrigerant flowing in said main refrigerant flow path between said receiver and evaporator means when said auxiliary subcooling means is energized.

12. A refrigeration system according to claim 10 or 11, wherein said auxiliary subcooling means further includes temperature sensing means located upstream of said heat exchange means for measuring the refrigerant temperature in the main refrigerant flow path upstream of the heat exchange means, and means coupled to said temperature sensing means and said auxiliary compressor means for energizing said auxiliary compressor means to cause refrigerant to flow through said auxiliary refrigeration circuit when the refrigeration temperature measured by said temperature sensing means exceeds a first preset upper limit and for terminating the flow of refrigerant through said auxiliary refrigeration flow path when the refrigerant temperature measured by said temperature means drops below a second lower limit equal to or less then said first preset upper limit, whereby when said auxiliary refrigeration circuit is energized, said heat exchange means extracts heat from the refrigerant flowing through the main refrigerant flow path between said receiver and said evaporator means.

13. A refrigeration system according to claim 12, wherein said temperature sensing means comprises a first sensor for measuring refrigerant temperature in the main refrigeration flow path between said receiver and said heat exchange means and a second sensor for measuring refrigerant temperature in the main refrigerant flow path downstream of the heat exchange means, and control means coupled with said first sensor for energizing said auxiliary compressor means when the refrigerant temperature measured by said first sensor exceeds said preset upper limit, said control means being coupled with said second sensor for shutting off said auxiliary compressor means when the refrigerant temperature measured by the second sensor decreases below said preset lower limit.

* * * * *

UNITED STATES PATENT AND TRADEMARK OFFICE

CERTIFICATE OF CORRECTION

PATENT NO. : 4,304,100

DATED : December 8, 1981

INVENTOR(S) : Fayez F. Ibrahim

It is certified that error appears in the above—identified patent and that said Letters Patent is hereby corrected as shown below:

Column 1, line 13, change "Abraham" to --Ibrahim--;
line 26, change "a the" to --the--;
line 58, change "100° ]]F" to --100°F--.

Column 2, line 52, change "depend" to --dependent--;
line 58, change "it" to --its--;
line 66, change "arises" to --rises--.

Column 3, line 4, change "then" to --than--;
line 62, change "condensor" to --condenser--.

Column 4, line 34, change "solenoil" to --solenoid--.

Column 5, line 17, change "Abraham" to --Ibrahim--;
lines 21-22, change "connected" to --connecting--.

Column 6, line 44, change "compresser" to --compressor--;
line 52, change "aforemention" to --aforementioned--.

Column 8, line 16, change "operates" to --operate--.

Column 10, line 57, change "condensor" to --condenser--.

UNITED STATES PATENT AND TRADEMARK OFFICE

CERTIFICATE OF CORRECTION

PATENT NO. : 4,304,100

DATED : December 8, 1981

INVENTOR(S) : Fayez F. Ibrahim

It is certified that error appears in the above—identified patent and that said Letters Patent is hereby corrected as shown below:

Column 11, line 49, change "seperate" to --separate--.

Column 12, line 51, change "condensor" to --condenser--;
line 65, change "a" to --A--.

Column 14, line 16, change "then" to --than--.

Signed and Sealed this

*Eighth* Day of *June 1982*

[SEAL]

*Attest:*

GERALD J. MOSSINGHOFF

*Attesting Officer*

*Commissioner of Patents and Trademarks*